US010174460B2

(12) United States Patent
Hunold et al.

(10) Patent No.: US 10,174,460 B2
(45) Date of Patent: Jan. 8, 2019

(54) RAIL FASTENING ARRANGEMENT AND SHIM FOR SUCH A RAIL FASTENING ARRANGEMENT

(71) Applicant: Vossloh-Werke GmbH, Werdohl (DE)

(72) Inventors: André Hunold, Iserlohn (DE); Winfried Bosterling, Neuenrade (DE)

(73) Assignee: Vossloh-Werke GmbH, Werdohl (DE)

( * ) Notice: Subject to any disclaimer, the term of this patent is extended or adjusted under 35 U.S.C. 154(b) by 130 days.

(21) Appl. No.: 14/897,879

(22) PCT Filed: Jun. 3, 2014

(86) PCT No.: PCT/EP2014/061460
§ 371 (c)(1),
(2) Date: Dec. 11, 2015

(87) PCT Pub. No.: WO2014/198585
PCT Pub. Date: Dec. 18, 2014

(65) Prior Publication Data

US 2016/0145812 A1 May 26, 2016

(30) Foreign Application Priority Data

Jun. 12, 2013 (DE) ..... 10 2013 106 123

(51) Int. Cl.
*E01B 9/68* (2006.01)
*E01B 9/40* (2006.01)

(52) U.S. Cl.
CPC ..... *E01B 9/685* (2013.01); *E01B 9/40* (2013.01)

(58) Field of Classification Search
CPC ..... E01B 9/00; E01B 9/38; E01B 9/44; E01B 9/54; E01B 9/62; E01B 9/68; E01B 9/40;
(Continued)

(56) References Cited

U.S. PATENT DOCUMENTS 4,113,178 A * 9/1978 Steinfeld ..... E01B 9/303 238/310
4,382,547 A * 5/1983 Phillips ..... E01B 9/10 238/281
(Continued)

FOREIGN PATENT DOCUMENTS

CN 1216078 A 5/1999
CN 201047044 Y 4/2008
(Continued)

*Primary Examiner* — Mark T Le
(74) *Attorney, Agent, or Firm* — The Webb Law Firm

(57) ABSTRACT

A rail fastening arrangement in which a rail for a rail vehicle is fastened to a base, and to a shim. The rail fastening arrangement includes two guide plates, of which one guide plate respectively is associated with one of the longitudinal sides of the rail, and a shim which is arranged between the base and the rail. The shim, at its top, has a contact area on which the rail is supported, and, at its bottom, has a supporting surface by way of which the shim is supported on the base. The contact area and the supporting surface of the shim, viewed in a section located transversely to the longitudinal extension of the rail, enclose an acute angle. The edge at which the shim is thinner is arranged beneath the rail, fastening of rails oriented at a cant relative to the vertical in the region of points.

9 Claims, 2 Drawing Sheets

(58) Field of Classification Search
CPC ..... E01B 9/685; E01B 9/303; E01B 9/306; E01B 9/483; E01B 9/30; E01B 9/34
USPC ..... 238/349, 351
See application file for complete search history.

(56) References Cited

U.S. PATENT DOCUMENTS

| | | | | |
|---|---|---|---|---|
| 5,203,501 | A | 4/1993 | Vanotti | |
| 6,257,495 | B1 | 7/2001 | Eisenberg | |
| 8,052,068 | B1 * | 11/2011 | Renneckendorf ..... | E01B 9/303 238/310 |
| 2002/0000475 | A1 | 1/2002 | Igwemezie | |
| 2008/0257972 | A1 * | 10/2008 | Vorderbruck ..... | E01B 9/303 238/331 |
| 2011/0272485 | A1 | 11/2011 | Renneckendorf et al. | |
| 2016/0017545 | A1 | 1/2016 | Bosterling et al. | |

FOREIGN PATENT DOCUMENTS

| | | | |
|---|---|---|---|
| CN | 102939417 | A | 2/2013 |
| CN | 203475241 | U | 3/2014 |
| DE | 263780 | C | 9/1913 |
| DE | 3423997 | A1 | 1/1986 |
| DE | 3512200 | A1 | 10/1986 |
| DE | 3611017 | A1 | 10/1987 |
| DE | 69926772 | T2 | 5/2006 |
| DE | 102007044098 | B3 | 4/2009 |
| DE | 102010038442 | A1 | 2/2012 |
| DE | 202011104743 | U1 | 3/2012 |
| DE | 102011003216 | A1 | 7/2012 |
| EP | 1321578 | A2 | 6/2003 |
| GB | 854290 | A | 11/1960 |

* cited by examiner

RAIL FASTENING ARRANGEMENT AND SHIM FOR SUCH A RAIL FASTENING ARRANGEMENT

CROSS-REFERENCE TO RELATED APPLICATIONS

This application is the United States national phase of International Application No. PCT/EP2014/061460 filed Jun. 3, 2014, and claims priority to German Patent Application No. 10 2013 106 123.0 filed Jun. 12, 2013, the disclosures of which are hereby incorporated in their entirety by reference.

BACKGROUND OF THE INVENTION

Field of the Invention

The invention relates to a rail fastening arrangement, such as a rail fastening point, in which a rail for a rail vehicle is fastened to a base. Rails to be fastened in such a fastening point usually have a rail head, on whose top there is constructed a running surface for the rail wheel of a rail vehicle, a rail web supporting the rail head, and a rail foot which, viewed in cross-section, is significantly wider, than the rail web and rail head and on which the rail web stands. In the fully assembled position the rail stands on the respective base with the rail foot, wherein various layers may be present between the rail and the base to impart the contact between the rail and the base.

A plate-like layer may therefore be arranged between the rail foot and the base, and this is composed of a material with exactly defined resilience and ensures that when the fastening point is driven over the rail resiliently sinks by a defined amount.

There may also be a shim between the rail foot and the base On the one hand this shim provides a contact area optimally adjusted to the shape of the bottom of the rail foot with which it is associated and in the process evens out in particular irregularities in the base. On the other hand the shim can be used to adjust a defined height position of the rail above the base.

Description of Related Art

In addition to the shim and the optionally present resilient intermediate plate, rail fastening points of the type being discussed here as a rule include two guide plates, of which one guide plate in each case is associated with one of the longitudinal sides of the rail. The guide plates absorb the transverse forces that occur when the rail held in the fastening point is driven over and deflect them into the base. To ensure accurate positioning of the guide plates even with a high load, the guide plates in many applications have an angled shoulder at the bottom associated with the base, with which shoulder they reach with interlocking fit into a recess formed in the base. Angled shoulder and recess are oriented parallel to the longitudinal extension of the rail, so the guide plate stays securely in its place even with high impact loads oriented transversely to the longitudinal extension of the rail. Guide plates designed in this way are also called "angled guide plates" in practice.

In addition to the lateral support of each rail to be fastened, in the case of the fastening points of the type being discussed here the guide plates also act as supporting and guiding elements for one spring element respectively which sits on the guide plates and exerts the resilient retaining forces, directed towards the base, for retaining the rail, on the foot of the rail. A fixing element constructed in the manner of a screw or a bolt may be provided to fix the spring element, and this fixing element is anchored in the base and acts against the spring element.

The base, to which a rail is fastened by means of a fastening point of the type being discussed here, is formed, as a rule, from a sleeper or slab which is formed from concrete or a similarly hard material.

As a rule, rails of a track for rail vehicles are mounted at a certain cant toward the centre of the track in order to adjust the orientation of their running surface to the conically shaped wheel running surfaces of the rail wheels with which the respective rail vehicle travels on the rails. This supports self-centering of the rail vehicle on the track.

By contrast, in the region of points the rails are, as a rule, vertical in order to simplify construction of the points. However, there is also the requirement here to mount the rails with a predefined cant to obtain the self-centering effect in the region of the points as well.

Attempts have been made to remove the complexity associated with providing a canted mounting surface for the rail by constructing cants on the respective base itself, by way of which cants the corresponding canted position of the rail is brought about. This procedure has proven to be decidedly laborious in terms of manufacturing technology, however, since different cants of the rail also have to be facilitated for curves with different curvatures.

As an alternative it has therefore been proposed to provide the cant by means of the base which forms part of fastening points of the type being discussed as standard.

One example of a correspondingly constructed fastening point is described in DE 10 2011 003 216 A1. In this prior art the fastening point comprises a receiving trough which is formed in the base and is delimited laterally by flanks. The rail is supported against the flanks in the manner already described above by means of two guide plates, one of which respectively sits between the longitudinal side and the associated flank of the receiving trough. In the case of the known fastening point, a shim is provided, moreover, for height compensation, and this extends beneath the two angled guide plates and the foot of the rail and is led as far as over the flanks which delimit the receiving trough. To impart a certain cant to the rail in relation to the vertical the intermediate plate can be asymmetrical, i.e. have a thickness which, starting from its side associated with one longitudinal side of the rail, decreases in the direction of the side which is associated with the other longitudinal side of the rail.

A further rail fastening point, in which a rail oriented at a cant relative to the direction of gravity is fastened, is described in DE 35 12 200 A1. In this fastening point the base is formed by a sleeper composed of steel. Placed on the base is a pad made from plastics material and which is wedge-shaped in cross-section and on which the rail to be fastened is located. At the ends of the supporting part located in the direction of the wedge there are transverse parts which have rounded, groove-like supporting surfaces. In the mounted state angled guide plates are located on these supporting surfaces and are additionally supported by means of support blocks which are mounted on the base laterally to and so as to adjoin the associated narrow side in each case of the respective pad.

SUMMARY OF THE INVENTION

Against the background of the prior art mentioned above the object of the invention was to create a fastening point and a shim suitable for such a fastening point, with which fastening of rails oriented at an cant relative to the vertical, and in particular in the region of points, is simplified further.

The invention proceeds from the idea that, with minimum material expenditure and optimally simple mounting, secure fastening of rails oriented at a cant with respect to the vertical may be provided easily and inexpensively by using a shim in a fastening point according to the invention which, at least on one longitudinal side, does not extend beyond the rail below the guide plate provided there and instead is led as far as the respective longitudinal edge at most.

A rail fastening point according to the invention, in which a rail for a rail vehicle is fastened to a base, accordingly comprises two guide plates, of which one guide plate respectively is associated with one of the longitudinal sides of the rail, and a shim which is arranged between the base and the rail, wherein, at its top associated with the rail, the shim has a contact area, on which the rail is supported, and, at its bottom associated with the base, has a supporting surface, by way of which the shim is supported on the base, and wherein the contact area and the supporting surface of the shim, viewed in a section located transversely to the longitudinal extension of the rail, enclose an acute angle, so, at its edge associated with one longitudinal side of the rail, the shim is thinner than in its region associated with the other longitudinal side of the rail, the edge, at which the shim is thinner, being arranged beneath the rail.

According to the invention, the shim projects laterally beyond the rail with the shim's thicker region being associated with the other longitudinal edge of the rail. Furthermore, according to the invention at the top side of the shim in the region of the shim projecting laterally beyond the associated longitudinal edge, a recess is formed which is oriented parallel to the longitudinal extension of the rail, in which recess an angled section sits with interlocking fit, the section being formed onto the bottom of the guide plate associated with the shim.

A particular advantage of the invention lies in that the, according to the invention wedge-shaped, shim may be mounted particularly easily owing to its small dimensions, low weight and in particular due to the fact that at most a single guide plate is placed on it. This applies to pre-assembly on the one hand, but also to replacement if a worn shim is to be replaced by a new one. At the same time, because the shim ends under the rail, it is possible to achieve maximum canted orientations of the rail without large-volume components having to be used or complex concrete constructions having to be employed.

The invention therefore provides a rail fastening point which, due to the reduction in material achieved, can be implemented particularly inexpensively as well as being easy to mount. Expensive constructions and greater production expenditure are therefore avoided.

To ensure full support of the rail it may be advantageous if, as already mentioned, the edge, at which the shim is thinner, is arranged in the region of one of the longitudinal edges of the rail to be fastened, and in particular is oriented flush with the longitudinal edge of the rail with which it is associated. Alternatively its position may also be adjusted such that the thin edge of the shim abuts against the guide plate, which is associated with the longitudinal edge of the rail, behind which the shim remains according to the invention, and beyond which the shim does not project according to the invention therefore.

Accordingly, in accordance with the invention the shim is arranged with its thin edge below the rail, i.e. in the case where the rail has a pronounced rail foot, within the surface area covered by the rail foot, and is associated with one of the longitudinal edges of the rail, while the thicker region, associated with the other longitudinal edge of the rail, projects laterally beyond the rail. This has the advantage firstly that the shim is supported particularly securely with its thicker region, and the risk of tilting of the rail is minimised despite its canted position.

Secondly, the thicker part of the shim, which projects laterally beyond the rail, can be used as a supporting base for a guide plate which, placed on the shim, guides the rail at its longitudinal edge associated with the projecting region of the shim.

To enable easy, positionally correct mounting of the guide plate and simple orientation of the further components of the fastening point at the same time, the contact area, on which the rail is supported, can be extended laterally as far as the region projecting beyond the associated longitudinal edge of the rail.

The correct positioning and support of the shim can be assisted by a projection being formed on the bottom of the shim, with which projection the shim catches with interlocking fit in a recess formed in the base. In this way the shim is supported on the base with interlocking fit, so a transverse movement as a consequence of the high forces that occur when the fastening point is driven over by a rail vehicle is ruled out. Transverse forces absorbed by the shim are deflected directly into the base by way of the interlocking connection. The recess advantageously has a geometry that is trapezoidal in cross-section, and this ensures reliable force removal combined with an optimum self-locating positioning of the base.

Securing of the guide plate arranged on the thicker region of the base which projects beyond the rail ensured in accordance with the invention in that a recess oriented parallel to the longitudinal extension of the rail is formed at the top of the shim in the region of the shim projecting laterally beyond the associated longitudinal edge. An angled section sits in this recess with interlocking fit and is formed on the bottom of the guide plate associated with the shim. A relative movement of these two components transversely to the longitudinal extension is reliably avoided even with high loads by way of the interlocking connection thus formed between the shim and the guide plate. The forces transferred from the guide plate to the shim can then be deflected directly into the base if the shim is coupled to the base with interlocking fit in the manner described above. Optimum use and distribution of material results if the recess is arranged at the top and the projection at the bottom of the shim, one above the other. It may also be expedient here if the recess has a geometry that is trapezoidal in cross-section, ensuring reliable force removal combined with optimum, self-locating positioning of the guide plate on the shim. The reliable deflection of the transverse forces absorbed by the guide plate during operation ensures that the fixing element used to fix the spring element arranged on the guide plate is largely free of heavy stresses, thereby ensuring its long life.

To be able to conventionally fix a spring element, which is supported on a guide plate sitting on the thicker region projecting beyond the rail, using a fixing means, such as a tensioning screw or a tensioning bolt screwed into the base, it is expedient if a through-opening is formed in the region of the shim projecting laterally beyond the rail, leading from the top of the shim to its bottom. The through-opening is oriented so as to be aligned with a correspondingly arranged through-opening in the guide plate and if the respective fixing element is led through the mutually aligned through-openings it catches in the base to fix a spring element supported on the guide plate.

To impart a defined elastic resilience to the fastening point a resilient intermediate layer may also be provided between the rail and the shim in the case of a rail fastening point according to the invention. Alternatively it is of course likewise possible to arrange a rigid intermediate plate between the rail and the shim to reinforce the rail fastening point according to the invention.

Raising or tilting of the guide plates in the case of unfavourable loads can be reliably prevented in that, on an end-face contact surface associated with the rail, at least one of the guide plates optionally has a strip-like projection with which it catches under the longitudinal edge of the rail with which it is associated.

Basically it is conceivable to construct the contact area and the supporting surface of the shim in such a way respectively that their shape is adapted to the respective local conditions. Versatility results however if, on an end-face supporting surface associated with the rail, at least one of the guide plates has a strip-like projection with which it catches in the recess, which is delimited by the bottom of the rail associated with the base, a narrow side of the resilient plate and the top of the shim. This design also takes into account the fact that the bottom of a rail foot is likewise substantially flat as a rule and the intermediate layers optionally arranged been rail and shim are, as a rule, plate-like with flat faces associated with each other.

According to the explanations given above, a shim for a rail fastening point constructed according to one of the preceding claims has a top, on which a contact area is provided for a respective rail to be fastened, and a bottom, on which there is a supporting surface provided for placing on a base. According to the invention the contact area and the supporting surface enclose an acute angle, so the shim is thinner at one side than at its other side.

In the event that the shim is to project beyond the associated longitudinal edge of the shim in the assembled position, a region may be connected solely to the thicker side of the shim, and this is provided to support a guide plate that can be placed on the region.

If an angled guide plate is to be supported on the shim by its downwardly projecting angled section then it is expedient if, on the top of the guide plate in the region provided to support a guide plate which can be placed thereon, a recess is formed which is oriented transversely to the longitudinal extension of the shim. The angled section of the guide plate then catches in this recess, so, in the mounted position, the guide plate is fixed to the shim with interlocking fit and non-displaceably transversely with respect to the rail.

Following the same pattern, constructed on the bottom of the shim there can be a projection which, in the mounted position, catches in a correspondingly shaped recess in the base oriented parallel to the rail in order to secure the shim against displacement transversely to the rail.

The invention therefore links the advantages, which a rail fastening by means of guide plates and rail clips held on the guide plate has, with the possibility of an orientation of the rail canted with respect to the vertical, without a complex reconfiguration of the sleeper or slab forming the respective base being required for this purpose. The invention proves to be particularly advantageous in the fastening of rails of points on conventional turnout sleepers. The costs which accrue for production of turnout sleepers made from concrete with a cant can be avoided by the invention since the invention allows a canted arrangement of the points rails on conventional, flat turnout sleepers.

BRIEF DESCRIPTION OF THE DRAWINGS

The invention will be explained in more detail below with reference to drawings illustrating an embodiment. Schematically in each case.

DETAILED DESCRIPTION OF THE INVENTION

Figure 1:
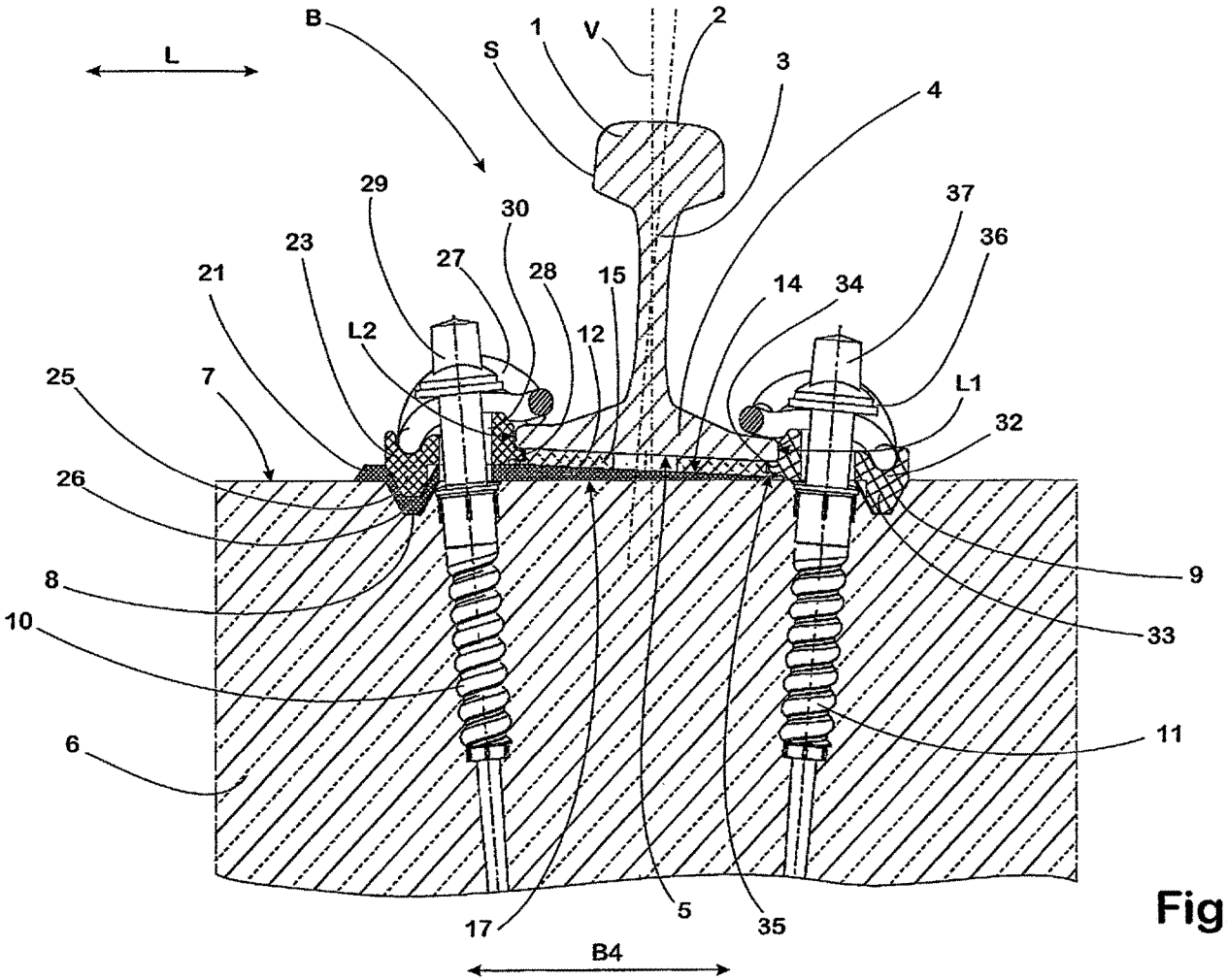
FIG. 1 shows a first fastening point for a rail in a section transverse to the longitudinal extension of the rail.
Figure 2:
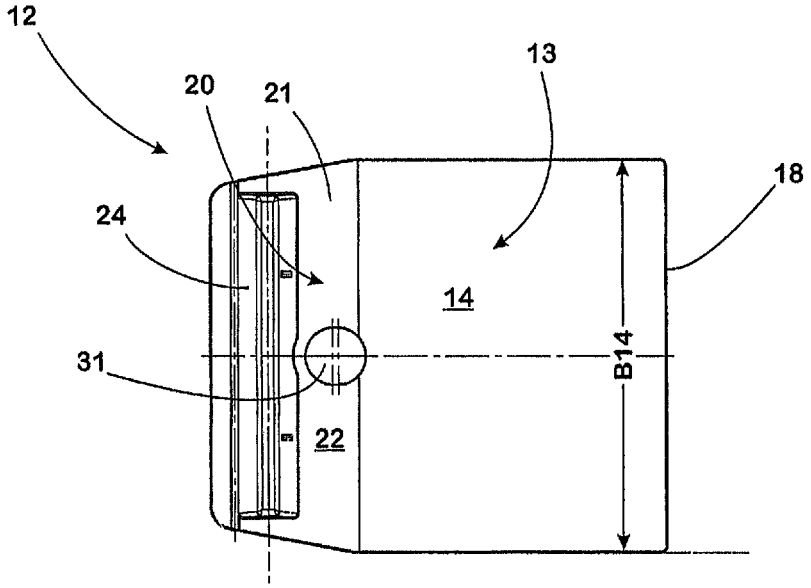
FIG. 2 shows a plan view of a shim used in the fastening point according to FIG. 1.
Figure 3:
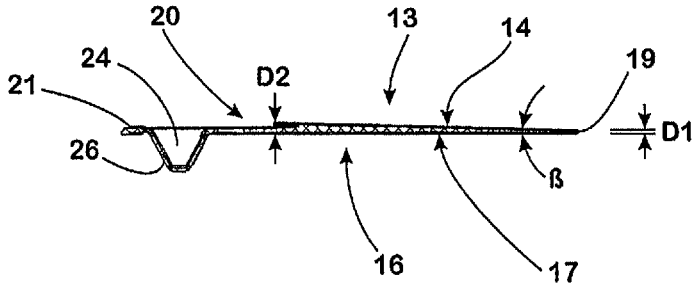
FIG. 3 shows a side view of the shim according to FIG. 2.

Fastened in the rail fastening point B illustrated in FIG. 1 is a rail S which conventionally comprises a rail head 1, on whose top a running surface 2 for a rail wheel (not seen here) of a rail vehicle (likewise not shown), a rail web 3 supporting the rail head 1 and a rail foot 4 on which the rail web 3 is centrally arranged. The rail foot 4 is wider than the rail head 1 and has a flat supporting surface 5 at its bottom.

The rail fastening point B has a base 6, which in the present example is formed by a sleeper of the conventional type and cast in concrete. At its top the base 6 has a flat contact area 7 which extends over the length of the base 6 measured in the longitudinal direction L of the base oriented transversely to the rail S.

Formed in the contact area 7 at a spacing from each other are two groove-like recesses 8, 9 which extend parallel to each other and parallel to the longitudinal extension of the rail S. The recesses 8, 9 have an approximately trapezoidal cross-section which widens toward the contact area 7 of the base 6.

Furthermore, two plastics material dowels 10, 11 are let into the base in the region delimited by the recesses 8, 9. The recesses 8, 9 and the plastics material dowels 10, 11 are each arranged at the same distance and symmetrically to the longitudinal axis of the rail S.

A shim 12 produced from a plastics material, in particular from a fibre-reinforced plastics material, rests on the base 6. The shim 12 has a top 13, associated with the rail S, on which a flat supporting surface 14 is constructed.

Resting on the supporting surface 14 is a plate-like intermediate layer 15 which is composed of an elastic material with defined resilience. The intermediate layer 15 covers the rail foot 4 over its width B4 and extends over the width B14 of the supporting surface 14 of the shim 12. The rail S rests on the flat side of the intermediate layer 15 with which it is associated, so the rail S is supported by the intermediate layer 15 on the supporting surface 14 of the shim 12.

At its bottom 16 associated with the base 6 the shim 12 has a likewise flat supporting surface 17 with which is rests on the base 6. Viewed from the side the contact area 14 is oriented so as to be canted with respect to the supporting surface 17, so the contact area 14 and the supporting surface 17 enclose an acute angle β. The contact area 14 and the supporting surface 17 meet at the narrow side 18 of the shim 12 at which a correspondingly thinner edge 19 of minimised thickness D1 is formed. The shim 12 is accordingly thinner at the narrow side 18 associated with the edge 19 than in the region of its opposing narrow side 20, delimiting the contact area 14, in whose region the thickness D2 of the shim is considerably greater than the thickness D1.

The length of the contact area 14 of the shim 12 is dimensioned such that its end region associated with the narrow side 18 is located in the region of a longitudinal edge L1 of the rail foot 4, while the opposing end region of the contact area 14 is positioned close to the other longitudinal edge L2 of the rail foot 4 when the fastening point B is completely assembled.

The shim 12 is extended beyond the end region of the contact area 14, associated with the longitudinal edge L2, in which it has the greatest thickness D2, by a region 21 at which a flat contact area 22 oriented parallel to contact area 17 is provided for a guide plate 23 conventionally constructed as an angled guide plate.

Formed in the contact area 22 is a groove-shaped recess 24 which extends parallel to the narrow side 18 and, when the fastening point is completely assembled, is accordingly oriented parallel to the rail S and transversely to the longitudinal direction of the shim 12, which in plan view has a rectangular, elongated shape. The shape of the recess 24 is adapted to an angled section 25 of the guide plate 23 projecting in the direction of the base 6 such that, when the fastening point B is completely assembled, the angled section 25 sits in the recess 24 with interlocking fit. At the same time the shim 12 is curved downwards in the region of the recess 24, so a projection 26 is also formed there. Its external shape is adapted to the shape of the associated recess 8 formed in the base 6 in such a way that, when the fastening point B is completely assembled, the projection 26 is held in the recess 8 with interlocking fit.

Arranged on the conventionally shaped guide plate 23, which sits on region 21 of the shim 12 laterally projecting beyond the associated longitudinal edge L2 of the rail S, is a spring element 27 constructed as a conventional W-shaped rail clip which, in a manner known per se, exerts a resilient retaining force on the rail foot 4 with the free ends of its retaining arms.

Formed on the guide plate 23 in the region of the edge between its contact surface adjoining the longitudinal edge L2 of the rail foot 4 in the assembled position and its bottom is a strip-like projection 28 which, when the guide plate 23 is completely assembled, catches under the longitudinal edge L2 of the rail foot 4 with which it is associated and in the process abuts against the edge of the intermediate layer 15 with which it is associated. The projection 28 which catches under the rail foot 4 reliably prevents the guide plate 23 from tilting about a tilt axis running through the recess 24 and consequently lifting up from the shim 12 in the case of high loads.

A fixing element 29 constructed as a conventional sleeper screw is provided to fix the spring element 27 arranged on the guide plate 23. The fixing element 29 is led through the middle loop in the spring element 27, a through-opening 30 in the guide plate 23, formed in the guide plate 23 and leading from the top thereof to its bottom, and a through-opening 31 in the shim 12 arranged so as to be aligned with through-opening 30, and screwed into the associated dowel 10 let into the base 6. The middle loop of the spring element 27 is thus pulled in the direction of the base 6 by way of the head of the fixing element 29 and the spring element 27 is twisted as a whole such that the required retaining force is exerted on the rail foot 4.

A guide plate 32 is also arranged on the side of the rail S associated with the other longitudinal edge L1. The guide plate 32 is shaped and dimensioned in exactly the same way as guide plate 23. In contrast to guide plate 23, however, guide plate 32 sits directly on the contact area 7 of the base 6 and catches with its angled section 33 in the recess 9 in the base 6 associated with this side. The angled section 33 and the recess 9 are likewise adapted to each other such that, when the fastening point B is completely assembled, the angled section 33 is held in the recess 9 with interlocking fit.

With its strip-like projection 34 associated with the rail foot the guide plate 32 catches under the longitudinal edge L1 of the rail S with which it is associated and abuts against the thin narrow side 18 of the shim 12 on the one hand and against the edge of the resilient intermediate layer 15 with which it is associated on the other hand. At the side associated with the bottom of the guide plate 32 the strip-like projection 34 has a recess whose shape and size are chosen such that, when fastening point B is completely assembled, the projection 34 sits above a narrow covering region 35 on the end region of the contact area 14 associated with the narrow side 18. Lifting or tilting of the shim 12 is likewise reliably prevented in this way.

Also arranged on the guide plate 32 is a spring element 36 constructed as a conventional W-shaped rail clip, and with the free ends of its retaining arms this exerts a resilient retaining force on the side of the rail foot 4 with which it is associated. A conventional sleeper screw 37 is also provided here to fix the spring element 36 arranged on the guide plate 32. The sleeper screw 37 is led through the middle loop of the spring element 36 and through the through-opening in the guide plate 32 and screwed into the associated dowel 11 let into the base 6, so the middle loop of the spring element 36 is pulled in the direction of the base 6 and the spring element 36 as a whole is twisted such that the required retaining force is exerted on the rail foot 4.

As a consequence of the orientation, which is canted in relation to the supporting surface 17, of the contact area 14 of the shim 12 the rail S is arranged so as to be canted by an angle with respect to the vertical V, and this corresponds to the acute angle β enclosed between the supporting surface 17 and the contact area 14 of the shim 12.

LIST OR REFERENCE NUMERALS

1 rail head
2 running surface of the rail head 1
3 rail web
4 rail foot
5 supporting surface of the rail foot 4
6 base
7 contact area
8,9 recesses in the base 6
10,11 plastics material dowel
12 shim
13 top of the shim 12
14 flat contact area of the shim 12
15 intermediate layer made from a resilient material
16 bottom of the shim 12
17 supporting surface of the shim 12
18 thin narrow side of the shim 12
19 thin edge of the shim 12
20 thick narrow side of the shim 12
21 extended region of the shim 12
22 contact area of region 21 of the shim 12
23 guide plate
24 recess in the shim 12
25 angled section of the guide plate 23
26 downwardly protruding projection of the guide plate 23
27 spring element
28 strip-like projection of the guide plate

29 fixing element
30 through-opening in the guide plate 23
31 through-opening in the shim 12
32 guide plate
33 angled section of the guide plate 32
34 strip-like projection of the guide plate 32
35 overlapping region
36 spring element
37 sleeper screw
β angle enclosed by the supporting surface 12 and contact area 17
B rail fastening point
B4 width of the rail foot 14
B14 width of the supporting surface 14 of the shim 12
D1 thickness of the thin edge 19
D2 thickness of the thick narrow side 20
L longitudinal direction of the base 6
L1,L2 longitudinal edge of the rail S
S rail
V vertical line

The invention claimed is:

1. A rail fastening arrangement in which a rail for a rail vehicle is fastened to a base, comprising two guide plates, of which one guide plate respectively is associated with one of the longitudinal sides of the rail, and a shim which is arranged between the base and the rail, wherein the shim, at a top side associated with the rail, has a contact area on which the rail is supported, and, at a bottom side associated with the base, has a supporting surface by way of which the shim is supported on the base, and wherein the contact area and the supporting surface of the shim, viewed in a section located transversely to a longitudinal extension of the rail, enclose an acute angle, so, at a first edge associated with one longitudinal side of the rail, the shim is thinner than in a region associated with the other longitudinal side of the rail, wherein the first edge, at which the shim is thinner, is arranged beneath the rail, wherein, with its thicker region associated with the other longitudinal side of the rail, the shim projects laterally beyond the rail, and wherein, at the top side of the shim in the region of the shim projecting laterally beyond the associated longitudinal side, a recess is formed which is oriented parallel to the longitudinal extension of the rail, in which recess an angled section sits with interlocking fit, the section being formed onto a bottom side of the guide plate associated with the shim, wherein constructed on the bottom side of the shim is a projection with which the shim catches with interlocking fit in a recess formed in the base.

2. The rail fastening arrangement according to claim 1, wherein the first edge, at which the shim is thinner, is oriented flush with the longitudinal side of the rail associated with the first edge.

3. The rail fastening arrangement according to claim 1, wherein with the first edge, at which the shim is thinner, the shim abuts against the guide plate associated with the respective longitudinal side.

4. The rail fastening arrangement according to claim 1, wherein the contact area extends as far as the region projecting laterally beyond the associated longitudinal side of the rail.

5. The rail fastening arrangement according to claim 1, wherein the recess on the top side and the projection on the bottom side of the shim are arranged one above the other.

6. The rail fastening arrangement according to claim 1, wherein formed in the region of the shim projecting laterally beyond the rail, is a through-opening, leading from the top side of the shim to the bottom side of the shim, which is oriented so as to align with a correspondingly arranged through-opening in the guide plate, and in that a fixing element is led through the mutually aligned through-openings, and this catches in the base to fix a spring element supported on the guide plate.

7. The rail fastening arrangement according to claim 1, wherein a resilient intermediate layer is arranged between the shim and the rail.

8. The rail fastening arrangement according to claim 7, wherein, on an end-face contact surface associated with the rail, at least one of the guide plates has a projection in the form of a strip with which the projection catches under the longitudinal side of the rail with which the projection is associated.

9. The rail fastening arrangement according to claim 1, wherein the contact area and the supporting surface of the shim and a top of the base are each constructed so as to be flat.

* * * * *